US006808252B2

(12) United States Patent
Ohashi et al.

(10) Patent No.: US 6,808,252 B2
(45) Date of Patent: Oct. 26, 2004

(54) INK JET RECORDING HEAD AND MANUFACTURING METHOD THEREFOR

(75) Inventors: Tetsuya Ohashi, Chiba (JP); Yutaka Koizumi, Kanagawa (JP); Yukuo Yamaguchi, Tokyo (JP); Hiroyuki Kigami, Kanagawa (JP); Akira Goto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/437,172

(22) Filed: May 14, 2003

(65) Prior Publication Data

US 2004/0032472 A1 Feb. 19, 2004

(30) Foreign Application Priority Data

May 17, 2002 (JP) ..... 2002-143082
May 9, 2003 (JP) ..... 2003-131696

(51) Int. Cl.[7] ..... B41J 2/16
(52) U.S. Cl. ..... 347/47
(58) Field of Search ..... 347/47, 44, 40, 347/20, 23, 5, 6, 9, 1, 84, 85, 86, 87–95; 29/890.1

(56) References Cited

U.S. PATENT DOCUMENTS 5,682,190 A 10/1997 Hirosawa et al.
5,969,736 A 10/1999 Field et al.
5,997,122 A * 12/1999 Moriyama et al. ..... 347/11
6,168,264 B1 1/2001 Yoshihira et al.
6,241,350 B1 6/2001 Otsuka et al.
6,530,641 B2 3/2003 Ohashi et al.
2002/0033868 A1 3/2002 Ohashi et al.
2002/0075357 A1 6/2002 Ohashi et al.
2002/0118242 A1 8/2002 Tajima et al.
2003/0052950 A1 3/2003 Ohashi et al.
2003/0067517 A1 4/2003 Iri et al.

FOREIGN PATENT DOCUMENTS

EP 0 774 356 5/1997
EP 0 832 747 4/1998
EP 1 078 760 2/2001
EP 1 184 183 3/2002

* cited by examiner

*Primary Examiner*—Raquel Yvette Gordon
(74) *Attorney, Agent, or Firm*—Fitzpatrick, Cella, Harper & Scinto

(57) ABSTRACT

An ink jet recording head includes a liquid discharge head unit having discharge ports and ink flow paths; a liquid container holder unit capable of holding liquid containers and having supply paths for supplying liquid to the liquid discharge head units; and a buffer chamber for allowing gas to exist in the liquid supply paths, the buffer chamber being formed by coupling the liquid discharge head to the liquid supply holder unit. The ink jet recording head enables the buffer chamber allowing to gas to exist to be sufficiently cleaned, and requires no additional process for the formation of the buffer chamber thereof.

Furthermore, the ink jet recording head can inhibit ink oscillations in flow paths during ink discharge to keep a stable discharging state, thereby acquiring a high-quality image at all times.

9 Claims, 13 Drawing Sheets

INK JET RECORDING HEAD AND MANUFACTURING METHOD THEREFOR

BACKGROUND OF THE INVENTION

1. Field of the Invention

The present invention relates to an ink jet recording head that performs recording by discharging ink onto a recording medium such as paper or cloth, a printing apparatus employing this recording head, and a manufacturing method for this recording head.

2. Description of the Related Art

Hitherto, printing apparatuses such as printers, copiers, facsimiles or the like are configured to record images comprising dot patterns on a recording material based on image information. These printing apparatuses can be classified into an ink jet system, wire dot system, thermal system, laser beam system and so on, in accordance with a printing system. Of these systems, the ink jet system is configured to have an ink jet recording head and an energy converting unit for generating a discharge energy used for discharging ink on a liquid path thereof, and introduce ink from an ink supply port into the liquid path via a liquid chamber. Here, the ink jet system causes the ink drops to fly toward a recording material as flying liquid drops by using the discharge energy given to the ink by the energy converting unit, and performs recording by the shooting of the liquid-drops onto the recording material. Among others, the ink jet recording head, which discharges ink by making use of thermal energy, is in practical use, because the ink jet recording head has advantages in that it allows ink discharge ports for discharging ink drops for recording to form flying drops, to be arranged in a high density, and also enables the overall size thereof to be easily reduced. In recent years, with the demand for high speed recording, the number of nozzles arranged on the ink jet recording head has been increased.

In the ink jet system, because ink as a liquid is treated as an object, there may be cases where meniscus oscillations at discharge port portions are significantly disturbed by ink oscillations associated with continuous driving to thereby cause degradation of image quality. Particularly in the ink jet recording head having multi-nozzles arranged therein in a high density, the ink flow per unit time is high, and therefore, the forward inertia force acting on ink in a tank system becomes large when discharge is stopped, so that the nozzles are subjected to a positive pressure by the inertia force, and the meniscus of each ink drops becomes popped out. If the next print signal enters at this time, small ink drops splash and unfavorably results in a so-called splashing-fashioned print. FIG. 6 is a diagram of pressure oscillation waveforms in an ink flow path plotted against discharge pulses when a predetermined discharge was conducted in a conventional ink jet recording head. "A", "B", and "C" which are shown in FIG. 6 denote "a period before a start of discharge", "a discharging period", and "a period immediately after the stoppage of discharge", respectively. It can be seen from this diagram that the pressure oscillation amplitude (a) in the flow path after the stoppage of discharge comprises a large positive pressure value. These oscillations will disturb meniscus oscillations at the next discharge. Methods for eliminating such a phenomenon include a method by which meniscus oscillations are stabilized by adjusting flow resistance by the change in filter diameter or the changeover of ink flow path, and a method by which pressure oscillations are absorbed by forming a buffer chamber at a position midway through ink path to thereby allow bubbles to exist therein. The latter method using a buffer chamber is effective as a method for inhibiting pressure oscillations, and has been adopted for many types of ink jet recording heads.

Hitherto, a buffer chamber has been provided at a flow path portion connecting a head unit (element substrate) and a tank. However, because the buffer chamber has been far away from the head unit, it has not necessarily been able to respond to abrupt changes, although it has exerted an effect in refilling. Therefore, there has been request for a large-capacity buffer chamber provided near the head.

It is necessary for the buffer chamber to be configured so that a liquid is made difficult to enter thereinto by previously making the buffer chamber a closed space, in order to prevent gas in the buffer chamber from being replaced with ink. In this case, if dirt or the like has previously entered the buffer chamber, it is difficult to be removed by cleaning. Therefore, there has been possibility that the dirt or the like enters the flow paths during usage, and that the residual dirt or the like causes defective printing.

In addition, a drying operation after cleaning has unfavorably taken much time.

SUMMARY OF THE INVENTION

It is, therefore, an object of the present invention to provide an ink jet recording head having a buffer chamber with a large capacity near the element substrate and enabling the buffer chamber allowing gas to exist, to be sufficiently cleaned, and a method for manufacturing the same.

To solve the above-described object, the present invention provides an ink jet recording head that includes discharge ports each for discharging ink, flow paths each communicating with a respective one of the discharging ports; a common liquid chamber for supplying ink to the ink flow paths, an element substrate having discharge energy generating elements, and a holding member holding the element substrate and having the common liquid chamber and a plurality of paths communicating with the common liquid chamber. A portion of the plurality of paths is used as an ink supply path, and the other portion thereof is used as an air holding section formed by blocking an end portion of the path, opposed to the end portion thereof communicating with the common liquid chamber.

Also, to solve the above-described object, the present invention provide a method for manufacturing an ink jet recording head that includes discharge ports each for discharging ink, flow paths each communicating with a respective one of the discharging ports, a common liquid chamber for supplying ink to the ink flow paths, and an element substrate having discharge energy generating elements. This method comprises the step of providing the ink jet recording head with a holding member that holds the element substrate and that has the common liquid chamber and a plurality of paths communicating with the common liquid chamber, the step of joining the element substrate to the holding member, and the step of forming an air holding section by blocking an end of the path, opposite to the end thereof communicating with the common liquid chamber.

By virtue of the described features, the present invention makes it possible to provide a buffer chamber with a large capacity near the element substrate, sufficiently clean the buffer chamber allowing gas to exist, inhibit pressure oscillations in flow paths caused by ink oscillations during ink discharge to thereby maintain stable discharging conditions, and acquire a high-quality image at all times.

Further objects, features and advantages of the present invention will become apparent from the following description of the preferred embodiments with reference to the attached drawings.

DESCRIPTION OF THE PREFERRED EMBODIMENTS

Hereinafter, the embodiments of the present invention will be described with reference to the accompanying drawings.

First Embodiment

Figure 1B:
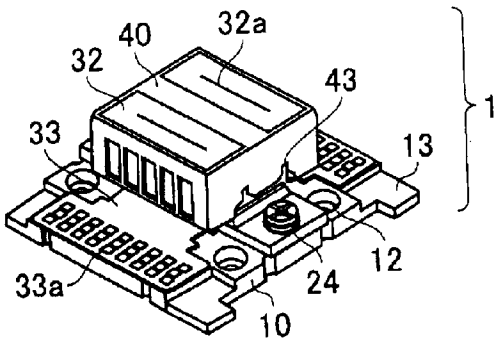
FIGS. 1A and 1B, respectively, are an perspective exploded view and assembly view of a liquid discharge head unit according to a first embodiment of the present invention.
Figure 1C:
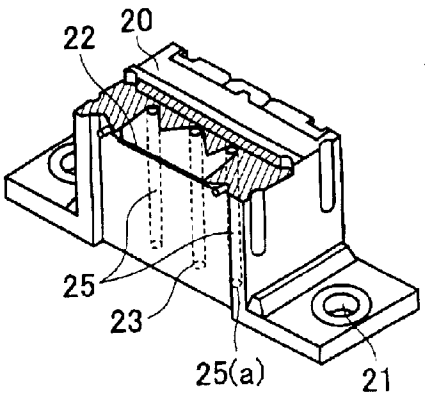
FIG. 1C is a partially sectional perspective view of the frame member of this liquid discharge head unit.
Figure 1A:
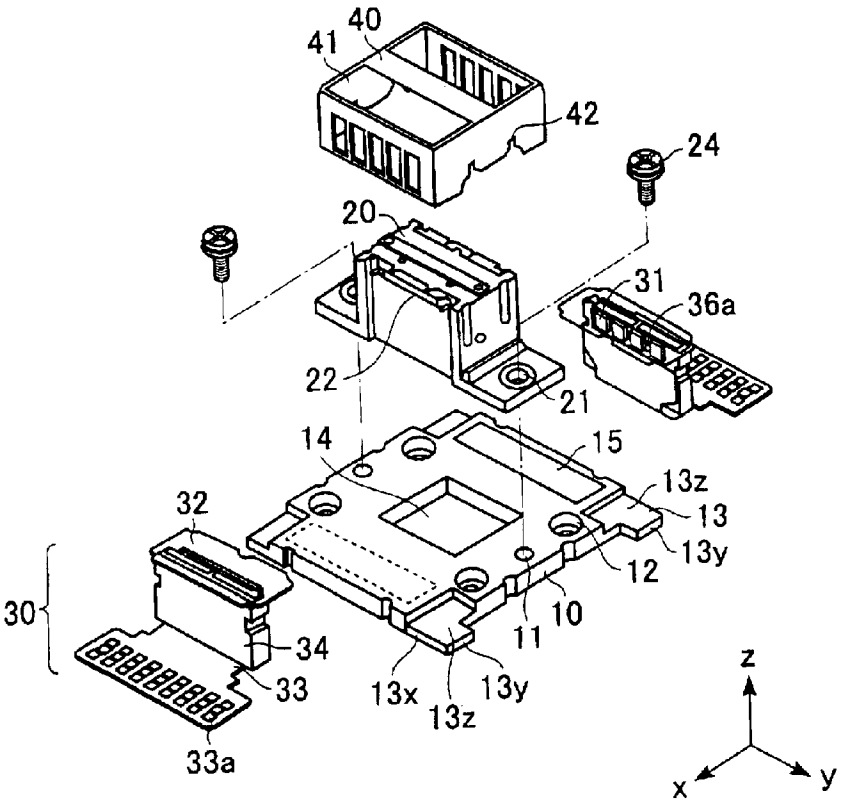
Figure 2:
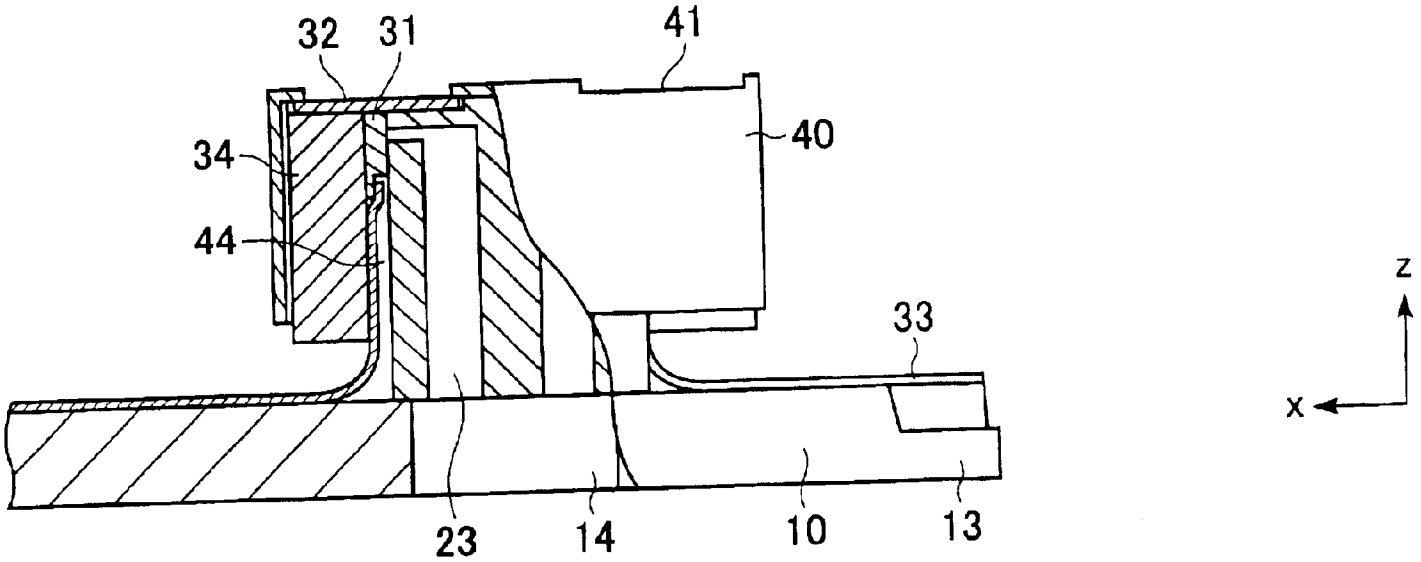
FIG. 2 is a partially sectional front view of the liquid discharge head unit shown in FIG. 1.
Figure 3B:
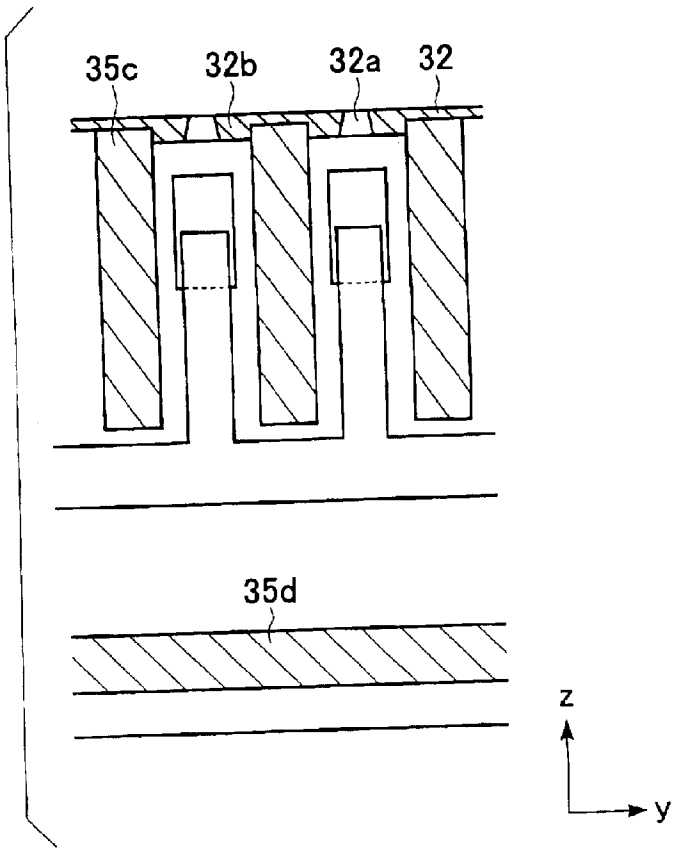
FIGS. 3A and 3B are schematic sectional views of a liquid discharge chip portion of the liquid discharge head unit shown in FIG. 1.
Figure 3A:
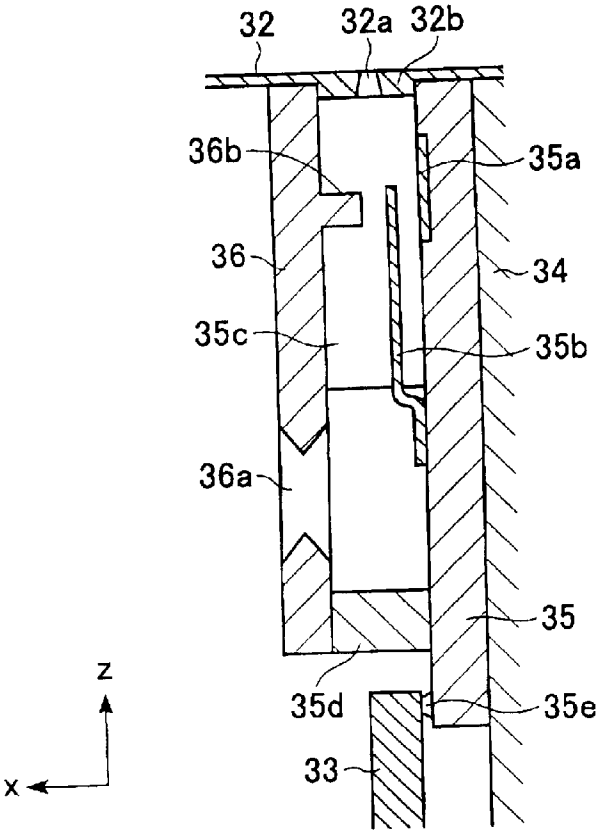

FIGS. 1A to 1C are schematic views showing a liquid discharge head unit 1 according to a first embodiment of the present invention, where FIGS. 1A and 1B, respectively, are an perspective exploded perspective view and assembly view thereof, and where FIG. 1C is a partially sectional perspective view of the frame member 20 of the liquid discharge head unit 1. FIG. 2 is a partially sectional front view of the liquid discharge head unit 1. FIG. 3 is a schematic sectional view of a liquid discharge chip 31 portion of the liquid discharge head unit 1.

The liquid discharge head unit 1 includes an aluminum base board 10, which serves as a base for the entire unit, a ceramic frame member 20 standing erect and installed so as to form a T-shape when viewed from the front, two chip units 30 joined to the opposite side surfaces the frame member 20, and a stainless-made front cap 40 jointed so as to be overlaid on the frame member 20 and the two chip units 30.

The base board 10 has lower portions at the four corners on the top surface thereof. Of these lower portions, two portions on the front side slightly extend frontward and sideward, thereby constituting main-body mounting references 13. Specifically, out of the mounting references 13, the end face extending leftward, the end face extending frontward, and the top surface, respectively, are an X-direction mounting reference 13*x*, Y-direction mounting reference 13*y*, and Z-direction mounting reference, and they are worked at respective predetermined surface accuracies. These mounting references 13 are used as positioning references of the liquid discharge head unit 1 relative to the main body. The base board 10 has mounting holes 12 for mounting it onto a liquid container holder unit (described later) formed at the four corners of higher portions of the base board 10 so as to penetrate the base board 10. At the central portion of the base board 10, there is provided an opening 14 for inserting the liquid supply portion of a head cartridge. At positions in front of and behind the opening 14, there are provided screw holes 11 with which screws 24 for mounting the frame member 20 are engaged.

In front of and behind its central portion extending upward, the frame member 20 has plate-shaped mounting portions in each of which a frame member mounting hole 21 is formed so as to penetrate the mounting portion. The frame member 20 is joined to the base board 10 by passing screws 24 through respective frame member mounting holes 21, then engaging the screws 24 with respective screw holes 11 of the base board 10, and fastening the frame member 20 to the base board 10. As shown in FIG. 1C, within the central portion of the frame member 20, there are provided at least two liquid supply paths 23 and at least two buffer chambers which extend from the bottom surface thereof upward, and each of which communicates with a liquid supply port 22 opened to the right and left side surfaces. As in the case of the liquid supply paths 23, each of the buffer chambers 25 has an opening in the bottom surface, and therefore, if left as it is, it has no function as a buffer chamber. However, in the process where the frame member 20 is cleaned by a water jet or the like, dirt in the buffer chambers is discharged to the outside via the buffer chambers and the liquid supply port 22 since the buffer chambers are opened, thus allowing cleaning of the buffer chambers. The openings in the bottom surface, of the liquid supply paths 23 and the buffer chambers are located within the opening 14 of the base board 10. A chip unit 30 is joined to the portion where the liquid supply port 22 is formed, the portion being on a side surface of the frame member 20.

The chip unit 30 comprises a liquid discharge heads chip 31 for discharging a liquid, a flexible cable 33 electrically connected thereto and transmitting drive signals thereto, and an alumina-made base plate 34 for supporting these liquid discharge head chip 31 and flexible cable 33.

The liquid discharge heads chip 31 is formed by arranging, at a predetermined spacing, a plurality of heaters (discharge energy generating elements) 35*a* for heating a liquid to bubble it, and it has a heater board 35 on which electric wiring lines (not shown) for transmitting signals to these heaters 35*a* are formed. On the heater board 35, there are provided a flow path wall 35*c* forming the side wall of the liquid flow path passing on each of the heaters 35*a*, and a liquid chamber wall 35*d* forming the side wall of a common liquid chamber for supplying a liquid to each of liquid flow paths. Onto these, a top plate 36 made of Si is affixed. A liquid receiving port 36*a* communicating with the common liquid chamber is formed in the top plate 36 so as to penetrate it. A bump 35*e* is provided at the portion of the heater board 35, extending downward up to the outside, and the flexible cable 33 is electrically connected to this bump 35*a*.

An orifice plate 32 in which a discharge port 32*a* communicating with each of the liquid flow paths is formed, is joined to the upper end of the liquid flow path formed by the heater board 35 and the top plate 36. On the joint surface of the orifice plate 32, there is provided a convex portion 32*b* projecting so as to enter each of the liquid flow paths in keeping with it. The formation of the convex portion 32*b* allows each of the fluid flow paths and a respective one of the discharge ports 32*a* to be positioned at a high accuracy, and also enables the joining strength of the orifice 32*a* to be enhanced.

In each of the liquid flow paths, there is provided a SiN-made movable member 35*b* that is supported in a manner of cantilever so as to be spaced upward apart from the heater 35*a* by a predetermined distance, and that has a movable portion displacing by a pressure generating due to the occurrence of bubbles. On the top plate 36, there is provided a displacement regulating member 36*b* that projects into the liquid flow path so as to be spaced by a predetermined distance apart from the movable portion of the movable member 35*b* for regulating the displacement of the movable member 35*b*. The formation of these movable member 35*b* and displacement regulating member 36*b* provides an advantage in that a pressure generating due to the occurrence of bubbles by the heater 35*a* can be effectively introduced to the discharge port 32*a* side, thereby allowing the liquid to be efficiently discharged.

The liquid discharge head chip 31 and the flexible cable 33 are joined onto the base plate 34 to form the chip unit 30. The chip unit 30 is joined to the opposite sides of the frame member 20 by an adhesive so that the liquid receiving port 36*a* of the liquid discharge head chip 31 and the liquid supply port 22 of the frame member 20 are communicated with each other. The adhesive does not applied to the surface of the liquid discharge head chip 31, having the liquid receiving port 36*a* therein, but is applied to the surfaces on opposite sides of the aforementioned surface and places other than the side surface of the frame member 20, having the liquid supply port 22 therein. As chip units, a chip unit discharging a single color of black is disposed on one side, and three chip units discharging colors of yellow, magenta, and cyan, respectively, are arranged on the other side. In a head chip to discharge inks of three colors, common liquid chambers and liquid receiving ports 36*a* are provided separately for every color.

At the end of the flexible cable 33, opposite to the end jointed to the liquid discharge head chip 31, there is provided a contact pad 33*a* electrically connected to the main body. The flexible cable 33 is constructed by forming printed wiring on a TAB (Tape Automated Bonding) tape, and it has flexibility. The flexible cable 33 is bent at the portion extending downward along the base plate 34, and is disposed so that the end where the contact pad 33*a* is provided is located on the top surface of the base board 10. The flexible cable 33 is jointed to that place by a hot melt sheet 15.

Above the orifice plate 32, the front cap 40 has an opening 41 that is narrower than that of the orifice plate 32, and in order to prevent the four sides of the orifice plate 32 from being exposed, the edge of the opening 41 of the front cap 40 is located on the four sides the orifice plate 32. The top surface of the front cap is coated with Teflon®, and has substantially equal water repellency to that of the orifice plate 32. In each of the front and rear surfaces of the front cap 40, there is provided holes 42 for a UV adhesive. Each of the holes for a UV adhesive extends from the bottom surface of the front cap 40, and on the way to the upper end thereof, it has a narrow portion that is partially narrowed in the neighbor of the upper end thereof. The front-end side with respect to the narrowed portion has a circular section portion with a larger diameter. Within the circular section portion at the upper end of the hole for a UV adhesive, a UV adhesive 43 is applied and solidified. As a result, even under load, the solidified UV adhesive becomes caught in the upper edge of the circular section portion of the hole 42 for a UV adhesive and the narrowed portion at the lower side, whereby the front cap 40 is fixed so as not to vertically move. In addition, the front cap 40 is fixed by a sealant 44 injected between the frame member 20 and the chip unit 30.

Thus, the front cap 40 covers the surroundings of the orifice plate 32, and projects upward with respect to the orifice plate 32. In this state, the front cap is securely fixed. The provision of the front cap 40 makes it possible to prevent the liquid discharge accuracy from being adversely affected by flaws and/or deformation of the orifice plate 32 with the discharge port 32*a*, caused by an external force acted on the orifice plate 32. The Teflon® coating applied over the top surface of the front cap 40 has high durability, and therefore, even if an external force in some degree is acted thereon, the water repellency thereof will not be lost and its change with time will be low.

Figure 4C:
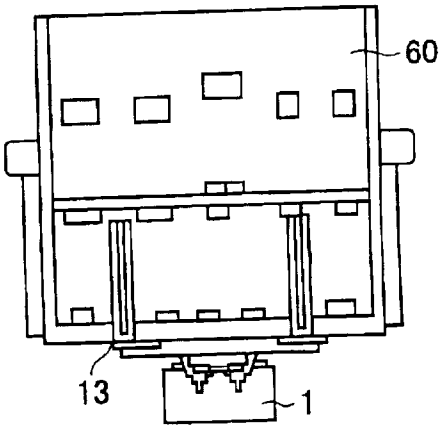
FIGS. 4A, 4B, and 4C, respectively, are a schematic side view, rear view, and bottom view of an ink jet recording head according to the first embodiment.
Figure 4A:
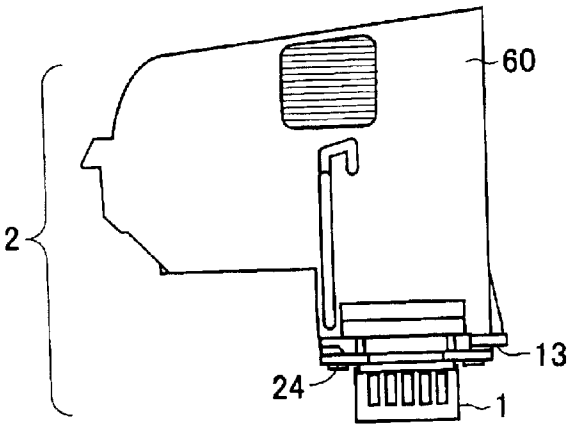
Figure 4B:
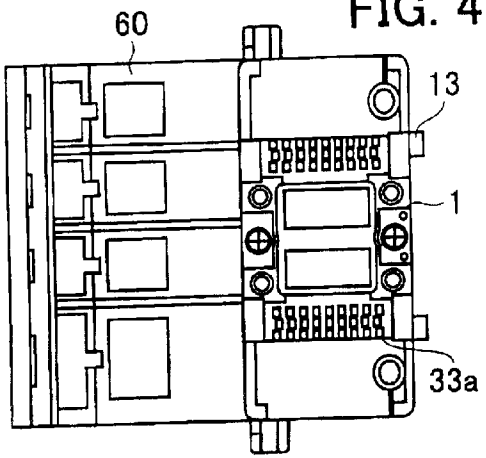
Figure 5A:
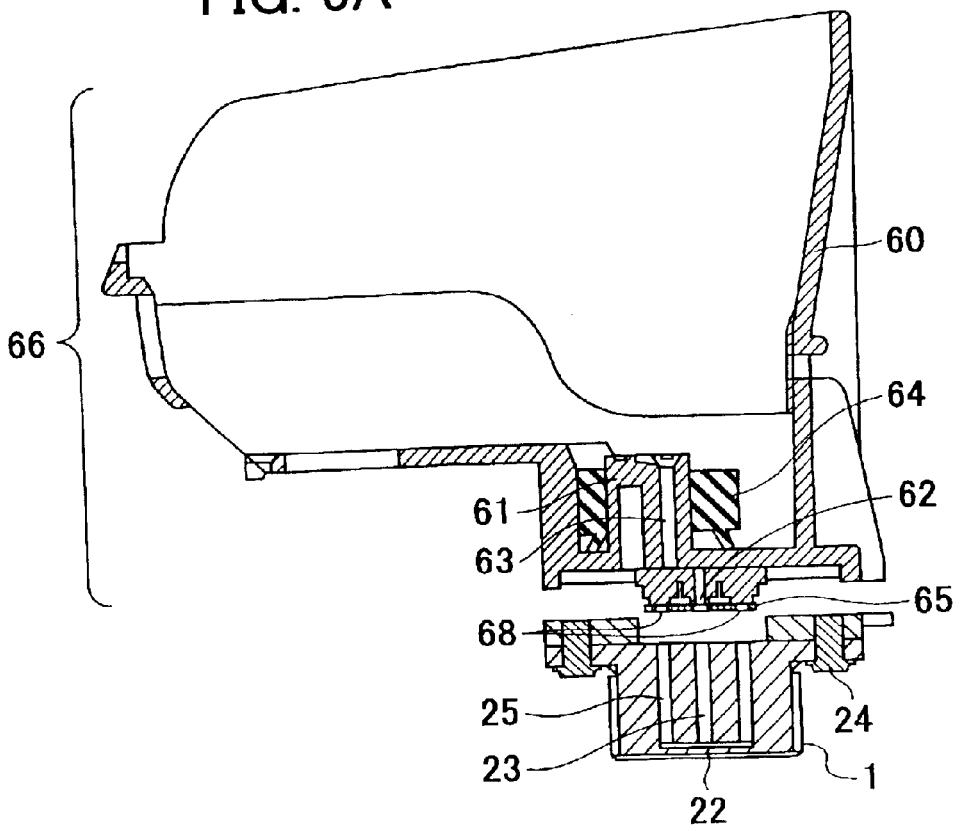
FIGS. 5A and 5B are schematic sectional views illustrating the coupling between the liquid discharge head unit and a liquid container holder unit of the ink jet recording unit shown in FIG. 4, wherein FIGS. 5A and 5B, respectively, are sectional views showing the states before and after coupling.
Figure 5B:
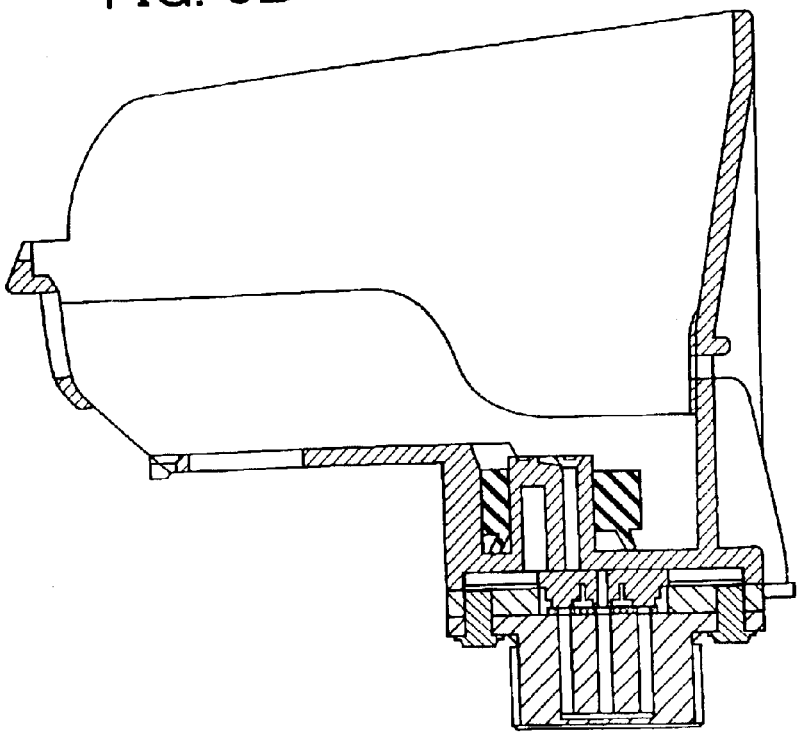
Figure 6:
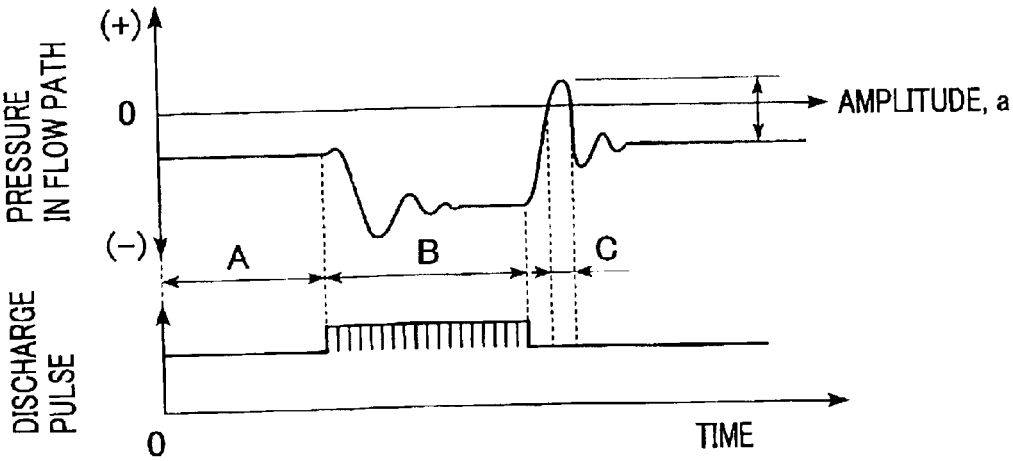
FIG. 6 is a diagram of pressure oscillation waveforms in an ink flow path, plotted against discharge pulses when a predetermined discharge was conducted in a conventional ink jet recording head.

The liquid discharge head unit 1 is mounted on the liquid container holder unit, as shown in FIGS. 4A to 4C and FIGS. 5A and 5B. FIGS. 4A, 4B, and 4C, respectively, are a side view, rear view, and bottom view of the liquid discharge head unit 1 when mounted on the liquid container holder unit. FIG. 5A is an exploded sectional view of the liquid discharge head unit 1 and the liquid container holder, and FIG. 5B is sectional view of the mounting portion of the liquid discharge head unit 1 with respect to the liquid container holder unit.

This liquid container holder unit has a liquid container holder 60 that can detachably hold a liquid container (not shown) storing liquid to be supplied to the liquid discharge head unit 1. The liquid container holder 60 has a box shape with the top surface thereof opened, and can hold therein liquid containers for storing three color inks of yellow, magenta, and cyan, and a slightly larger liquid container for storing a black ink. A joint portion 61 connected to the liquid supply portion 62 of a liquid container is provided on the bottom of the liquid container holder 60. A seal rubber 64 is mounted on the joint portion 61 in order to prevent the evaporation of liquid from this portion. Within the joint portion 61, there are provided liquid introducing paths 63. The liquid introducing path 63 communicates with the liquid supply portions 62 provided so as to project from the bottom surface of the liquid container holder 60. In the liquid supply portions 62, the plurality of liquid introducing paths 63 are formed in correspondence to the openings of the liquid supply paths 23 of the liquid discharge head unit 1. At the positions corresponding to the buffer chambers 25 of the frame chamber 20, dummy liquid supply portions 68 that are configured not to communicate with the liquid introducing path 63, are provided so as to project from the bottom surface of the liquid container holder 60.

The liquid discharge head unit 1 is jointed to the bottom surface of the liquid container holder 60 by screws 24 so that the frame member 20 thereof and the liquid supply portion 62 of the liquid container holder 60 are abutted against each other with a joint seal member 65 comprising an elastic material and having through holes at positions corresponding to the opening of the liquid supply paths 23 of the frame member 20 and that of the liquid introducing path 63 of the liquid supply portion 62 interposed therebetween. This abutting portion between the frame member 20 and the liquid supply portion 62 via the joint seal member 65 is located at substantially the center of the screwing positions of the four screws 24, and by using the four screws 24, the joint seal 65 can be effectively fastening, thereby causing the liquid introducing path 63 of the liquid container holder 60 and the liquid supply path 23 of the liquid discharge head unit 1 to smoothly communicate with each other. No flow paths are provided at the places of the liquid container holder 60, corresponding to the openings of the buffer chambers 25 provided in the frame member 20, and the openings of the buffer chambers 25 are sealed by connecting the openings of the buffer chambers 25 and the places corresponding to the openings of the buffer chambers 25 with the joint seal member 65 therewith. As a result, the buffer chamber becomes a close area. Thus, the buffer chambers absorbing ink oscillations during discharge can be formed without the need for an additional process and member. In this embodiment, the formation of the buffer chambers was performed by using an arrangement in which the frame member 20 and the base board 10 are separate. However, a similar effect can be achieved by an integral molded components using material such as resin. During ink sucking operation, since the buffer chambers 25 each form a close space, ink does not enter the buffer chambers, so that gas is held. The gas in the buffer chambers absorb pressure oscillations during ink discharge, thereby providing superior printing results.

Figure 7:
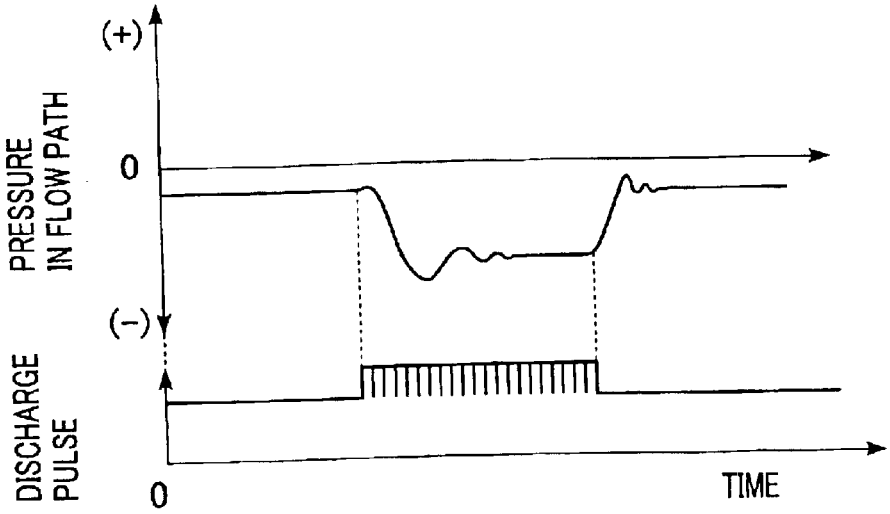
FIG. 7 shows the pressure oscillation waveforms in an ink flow path in the liquid discharge head unit according to the present invention.

FIG. 7 shows the pressure oscillation waveforms in a flow path during ink discharge in this embodiment. It can be seen from FIG. 7 that pressure oscillations after ink discharge are suppressed. A liquid discharge device mounting such an ink jet recording head is used as a printer or the like that forms images by discharging and shooting ink-drops onto a recording medium. The ink jet recording head is mounted on a carriage of the liquid discharge device body. The carriage holds a recording head at a position where discharge ports 32*a* are opposed to a recoding surface of the recording medium at a predetermined spacing, and is moved on the recording surface. During this movement, the heaters 35*a* are driven, and ink is discharged, whereby ink drops are shot onto a predetermined position of the recording medium.

Second Embodiment

Figure 8A:
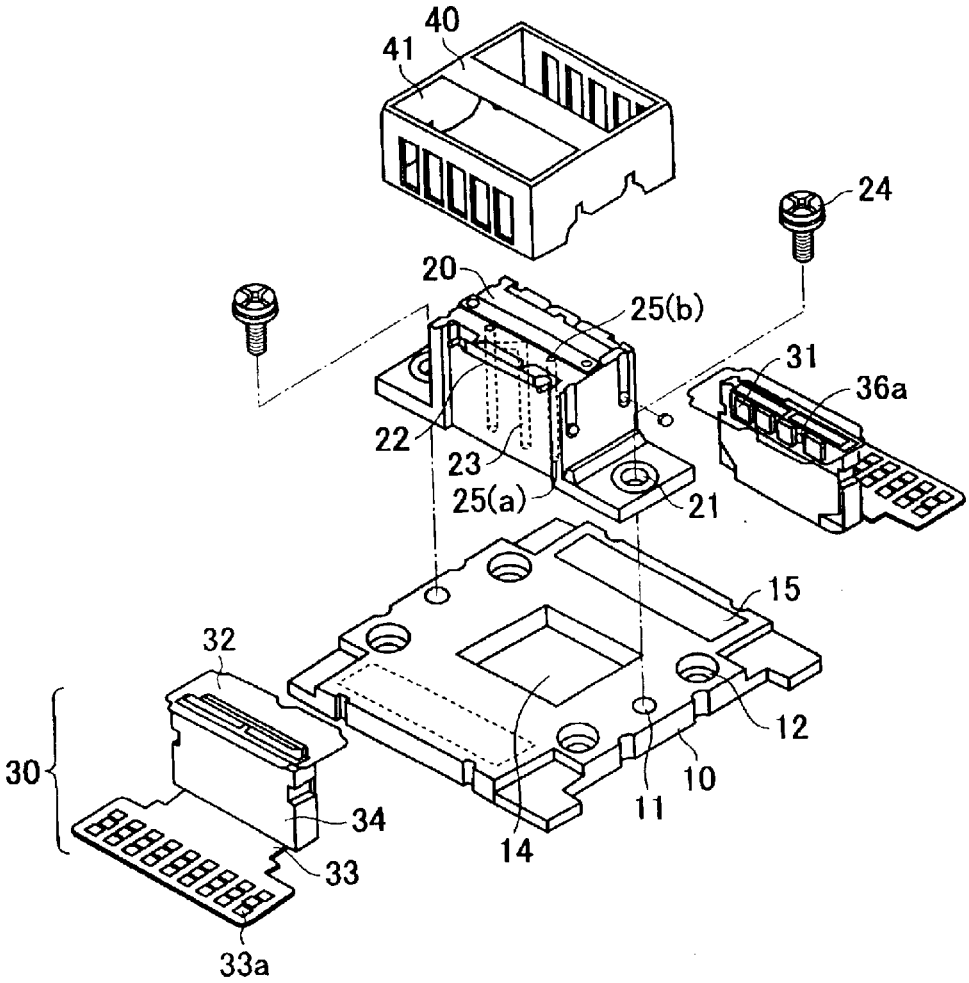
FIGS. 8A and 8B, respectively, a schematic perspective exploded view and perspective assembly view of a liquid discharge head unit according to a second embodiment of the present invention.
Figure 8B:
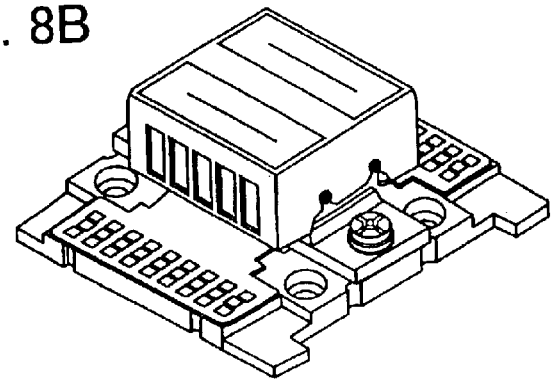
Figure 9:
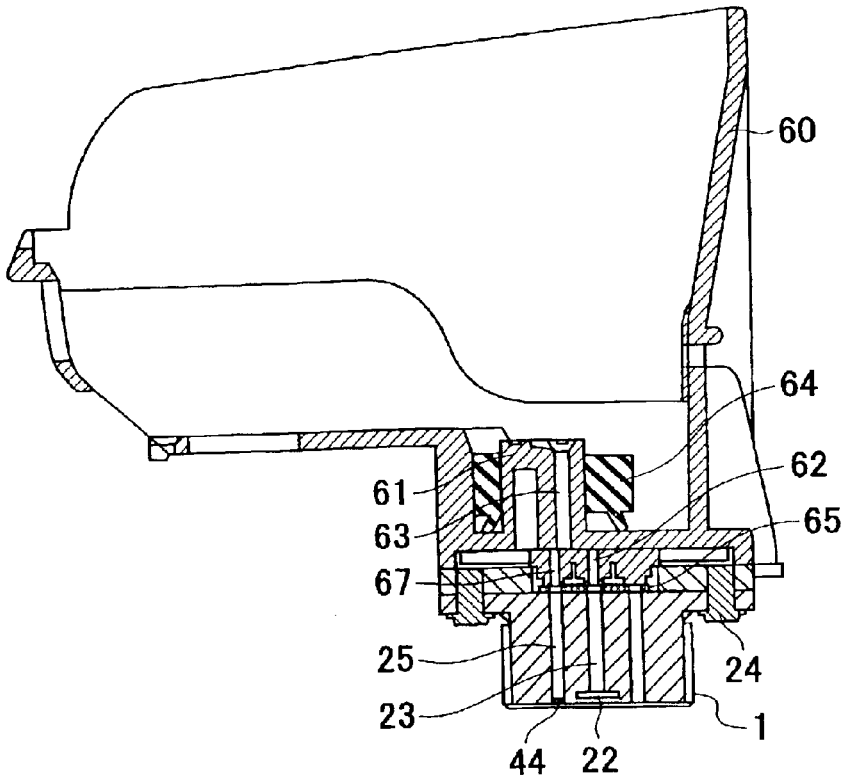
FIG. 9 is a schematic sectional view showing the liquid discharge head unit and a liquid container holder unit according to the second embodiment.

Next, a second embodiment of the present invention will be described with reference to drawings. FIGS. 8A and 8B, respectively, are a perspective exploded view and perspective assembly view of a liquid discharge head unit according to the second embodiment. FIG. 9 is a schematic sectional view showing the liquid discharge head unit and a liquid container holder unit according to the second embodiment.

As shown in FIG. 8, in an ink jet recording head according to this embodiment, the buffer chambers 25 do not communicate with liquid supply ports 22, and the opposite sides of thereof each has an open structure. This further facilitates the cleaning of the buffer chambers 25, and simplifies the structure of the mold for molding the frame member 20. By the sealant in the assembly process of the liquid discharge head unit 1 as described above, the openings 25(*b*) of the buffer chamber are sealed, thereby forming spaces each as a sealed buffer chamber. The sealing process is an ordinary process in the assembly operation of the liquid discharge head unit 1, and therefore, the sealing of the opening 25(*b*) does not require an extra additional process. If left as it is, each of the ink flow paths and a respective one of the buffer chambers 25 do not communicate with each other, so that each of the buffer chamber 25 has no function as a buffer chamber.

As shown in FIG. 9, when the liquid discharge head unit 1 and the liquid container holder unit are coupled together, the buffer chambers 25 communicates with the liquid introducing path 63 via a buffer chamber communicating path 67 in the liquid container holder unit. Thereby, it is possible to form a buffer chamber 25 allowing gas that absorbs pressure oscillations in the flow path during an ink discharge, to exist.

Third Embodiment

Figure 10:
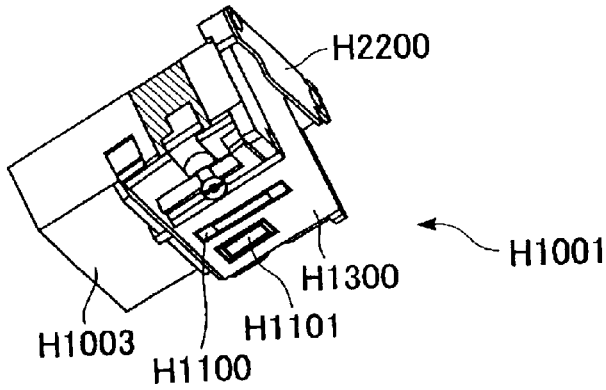
FIG. 10 is a schematic perspective view showing an ink jet recording head according to a third embodiment of the present invention.
Figure 11:
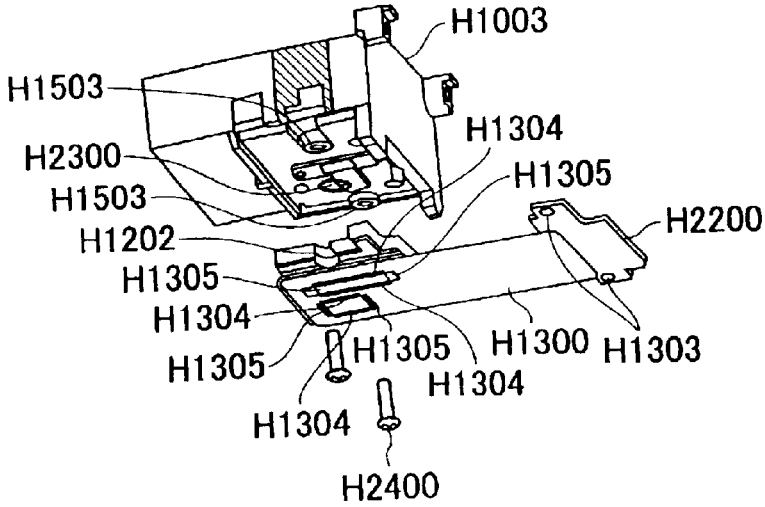
FIG. 11 is a schematic perspective exploded view showing the ink jet recording head according to the third embodiment.
Figure 12:
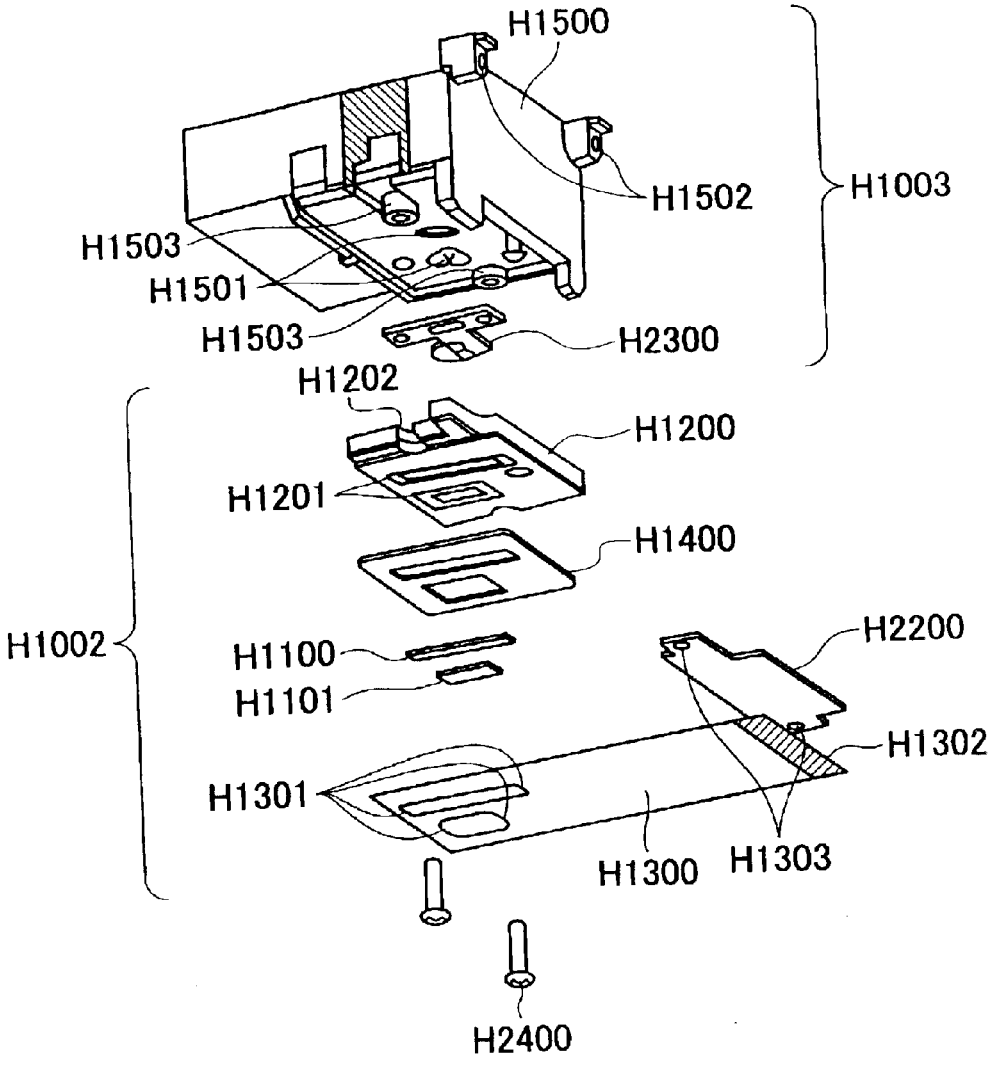
FIG. 12 is a schematic perspective exploded view showing the ink jet recording head according to the third embodiment, wherein the ink jet recording head is shown in further decomposed form.

FIGS. 10 to 12 are schematic perspective views showing an ink jet recording head according to a third embodiment of the present invention. The recording head mounted on an ink jet recording head H1001 is a bubble-jet® type recording head employing electrothermal converters each of which generates a thermal energy for causing film boiling to ink in accordance with an electrical signal. This is a so-called "side-shooter" type ink jet recording head, in which the electrothermal converters and the ink discharge ports are arranged so as to mutually opposed. In this embodiment, a system using the electrothermal converters was adopted, but the present invention can also be applied to an ink jet recording head that performs ink discharge by using piezo elements, which converts an electric signal into a pressure oscillation.

As shown in FIG. 10, the ink jet recording head H1001 comprises a liquid discharge head unit H1002 and a liquid container holder unit H1003, and the liquid discharge head unit H1002 is fixed to screwing bosses H1503 of the liquid container holder unit H1003 using screws H2400. After an electrical flexible cable H1300 has been bent, an electrical contact substrate H2200 is fixed to terminal connection portions H1502 of the liquid container holder unit H1003 via terminal connecting holes H1303 provided in the electrical contact substrate H2200. The fixation of the electrical contact substrate H2200 can be performed by screwing or boss welding or the like. As shown in FIG. 12, the liquid discharge head unit H1002 comprises a first recording element substrate H1100, second recording element substrate 1101, first plate H1200, electrical flexible cable H1300, electrical contact substrate H2200, and second plate H1400. In the liquid container holder unit H1003, a joint seal member H2300 is attached to a liquid container holder H1500.

In the liquid discharge head unit H1002, the first plate H1200 is formed of, for example, an alumina ($Al_2O_3$) plate with a thickness of 0.5 to 10 mm. However, the material of the first plate H1200 is not limited to alumina, but may be any other material that has an coefficient of linear expansion equivalent to that of the material of the recording element substrates H1100 and H1101, and that has a thermal conductivity equivalent to or more than that of the material of the recording element substrates H1100 and H1101. Therefore, the material of the first plate H1200 may be any one of, for example, silicon (Si), aluminum nitride (AlN), zirconium, silicon nitride ($Si_3N_4$), silicon carbide (SiC), molybdenum (Mo), and tungsten (W). As to the liquid supply paths 1201, the first plate H1200 has a liquid supply path 1201 for supplying black ink to the first recording element substrate 1100, and liquid supply paths 1201 for supplying inks of cyan, magenta, and yellow to the second recording element substrate 1101. On each of the opposite sides the first plate H1200, there is provided screwing portion H1202 for connecting the first plate H1200 to the liquid container holder unit H1003.

Figure 13A:
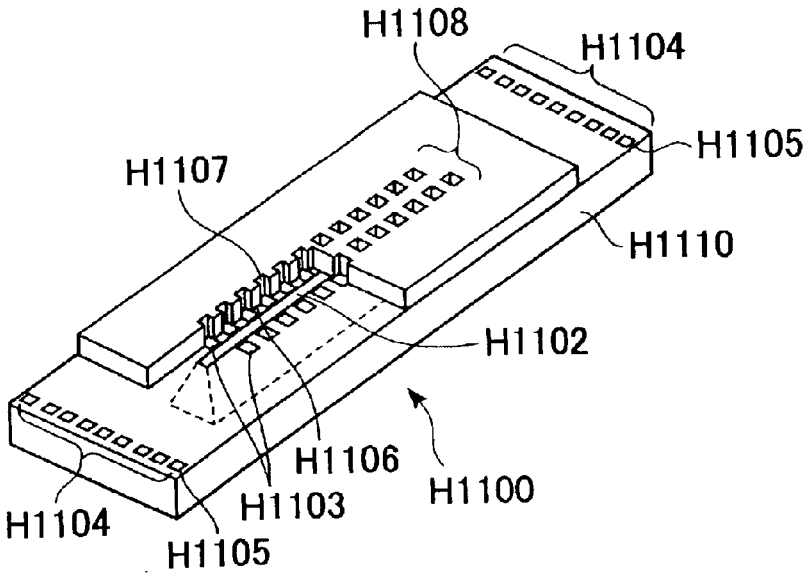
FIGS. 13A and 13B are partially cutaway perspective views, respectively, illustrating first and second recording element substrates in the ink jet recording head shown in FIGS. 10 to 12.
Figure 13B:
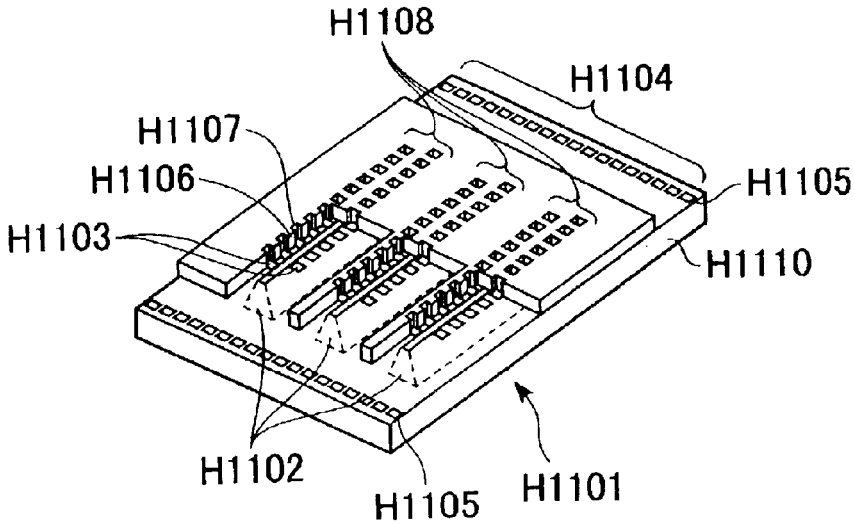

FIGS. 13A and 13B are partially cutaway perspective views, respectively, illustrating the first recording element substrate H1100 for black ink, which is high in frequency of usage, and the second recording element substrate H1101.

In the first recording element substrate H1100, a common liquid chamber H1102, which is a long-groove shaped through hole serving as an ink flow path, is formed in a Si substrate H1110 with a thickness of, for example, 0.5 to 1 mm. On each of the opposite sides with the common liquid chamber H1102 therebetween, electrothermal converting elements H1103 are arranged in a row, and electrical wiring lines (not shown) constituted of Al or the like are formed for supplying an electric power to the electrothermal converting elements H1103. These electrothermal converting elements H1103 and the electrical wiring lines are formed by a film deposition technique. Each of the rows of the electrothermal converting elements H1103 are arranged in a staggered configuration. That is, the discharge ports in each of the rows are arranged with the positions thereof slightly deviated from one another in a manner such that the individual discharge ports do not disposed in the direction perpendicular to the array direction. Also, an electrode portion H1104 for supplying an electrical power to the electrical wiring lines are formed along each of the opposite side edges outside the electrothermal converting elements H1103, and bumps H1105 constituted of Au or the like are provided on each of the electrode portions H1104.

Furthermore, on the surface where these are formed, of the Si substrate 1110, a resin-made structure that has ink flow path walls H1106 each forming an ink flow path corresponding to the electrothermal converting elements H1103 and ceilings covering the upper portion of each of the ink flow path walls H1106, and that has discharge ports H1107 each formed in the ceiling, is formed by a photolithography technique. The discharge ports H1107 are opposed to the electrothermal converting elements H1103, and forms a discharge port group. In the first recording element substrate H1100, ink supplied from the common liquid chamber H1102 is discharged from each of the discharge ports H1107 opposed to a respective one of the electrothermal converting elements H1103, under the pressure of bubbles generated by the heating of each of the electrothermal converting elements H1103.

On the other hand, the second recording element substrate H1101 is for discharging three color inks of cyan, magenta, and yellow, and has three common liquid chambers H1102 formed thereon in parallel. On each of the opposite sides with a respective one of the common liquid chambers H1102 therebetween, the electrothermal converting elements H1103 and ink discharge ports H1107 are arranged in a row in a staggered configuration. As in the case of the first recording element substrate H1100, on the Si substrate H1110, electrical wiring lines, the electrode portions H1104, and the like are further formed, and thereon, ink flow path walls H1106 and discharge ports H1107 are formed using a resin material by photolithography technique. Also, the bumps H1105 constituted of Au or the like are provided on each of the electrode portions H1104 for supplying an electric power to the electrical wiring lines, as is the case with the first recording element substrate H1100.

The recording element substrates H1100 and H1101 are connected to each other so that the respective common liquid chambers 1102 communicate with the respective liquid supply paths 1201 of the first plate H1200, and each of the recording element substrates H1100 and H1101 is securely adhered to the first plate 1200 so as to be positioned with high accuracy.

The second plate H1400 is a plate-shaped member with a thickness of, for example, 0.5 to 1 mm, and is formed of a ceramic such as alumina ($Al_2O_3$), or a metallic material such as Al or SUS. The second plate H1400 is configured to have two openings with external dimensions larger than those of the respective first recording element substrate H1100 and second recording element substrate H1101 securely adhered to the first plate 1200. The second plate H1400 is adhered to the first plate 1200 by a second adhesive. As a result, when the electrical flexible cable H1300 is adhered, it can be electrically connected to the first and second recording element substrates H1100 and H1101 by making contact with them at the adhesion plane between them.

The electrical flexible cable H1300 is for forming an electric signal path through which an electrical signal for discharging ink is applied to the first and second recording element substrates 1100 and 1101. The electrical flexible cable H1300 has two openings corresponding to the respective first and second recording element substrates 1100 and 1101. In the vicinity of these openings, there are provided electrode terminals H1301 connected to the electrode portions 1104 of each of the recording element substrates 1100 and 1101. At the end of the electrical flexible cable H1300, there are provided electrical terminal connection portions H1303 for establishing electrical connection with the electrical contact substrate H2200 having a connection terminal with respect to the outside, and each of the electrode terminals H1301 and an electrical terminal connection portion H1302 are connected by a continuous wiring pattern made of copper foil.

At its rear surface, the electrical flexible cable H1300 is securely adhered to the bottom surface of the second plate H1400 by a third adhesive, then it is bent toward one side surface side of the first plate H1200, and is securely adhered to the side surface of the first plate 1200. As the third adhesive, a thermosetting adhesive with a thickness of 10 to 100 $\mu$m, having an epoxy resin as a main ingredient, is employed.

The electrical connection between the electrical flexible cable H1300, the first recording element substrate 1100, and the second recording element substrate 1101 is established by, for example, electrically bonding the electrode portions H1104 of the recording element substrates 1100 and 1101, and the electrode terminals H1301 of the electrical flexible cable H1300, by ultrasonic thermocompression bonding. Here, the electrical connection portions between the recording element substrates 1100 and 1101, and the electrical flexible cable H1300 are sealed by a first sealant H1304 and second sealant H1305, respectively, whereby the electrical connection portions are protected against corrosion due to ink and external impacts. The first sealant 1304 is mainly used for sealing, from the rear side, the connection portions between the electrode terminals H1301 of the electrical flexible cable H1300 and the electrode portions of each of the recording element substrates 1100 and 1101, and for sealing the outer peripheral portion of each of the recording element substrates 1100 and 1101. On the other hand, the second sealant is used for sealing the above-described connection portions from the front side thereof.

Figure 14A:
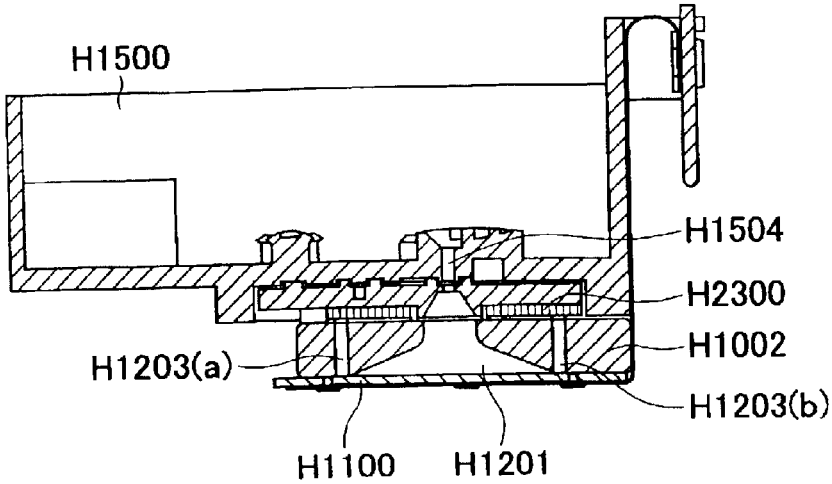
FIGS. 14A and 14B are schematic sectional views illustrating the coupling between the liquid discharge head unit and the liquid container holder unit of the ink jet recording unit shown in FIGS. 10 to 12.
Figure 14B:
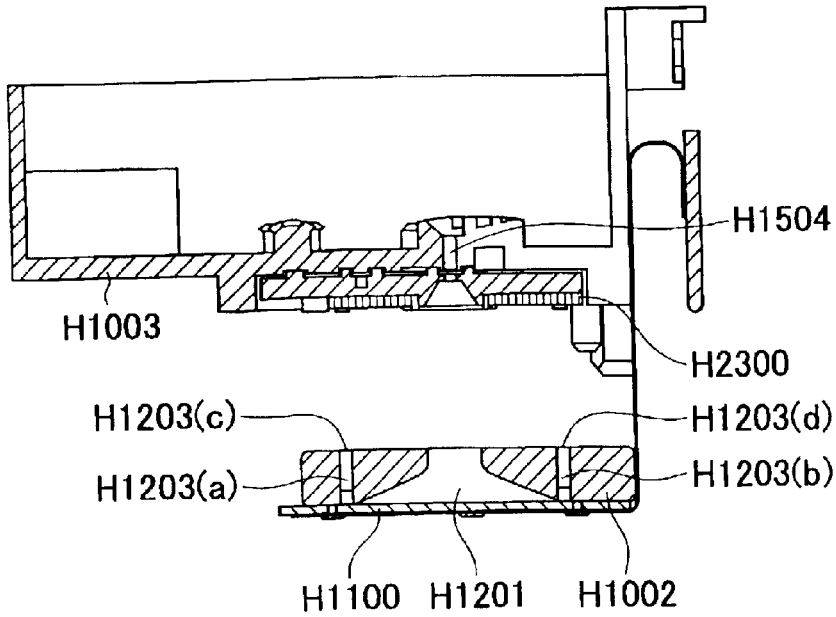

The electrical contact substrate H2200 is electrically connected to the end of the electrical flexible cable H1300 by thermocompression bonding, using an anisotropic conductive film or the like. FIGS. 14A and 14B are schematic enlarged views illustrating the sections in the array direction of the discharge ports in the first recording element substrate H1100 portion of the ink jet recording unit shown in FIGS. 10 to 12. The first plate H1200 constituting the liquid discharge head unit H1002 has bubble buffer chambers H1203(*a*) and H1203(*b*) each of which communicates with the opposite ends of the liquid supply path H1201. Here, the bubble buffer chamber H1203(*a*) and H1203(*b*), respectively, has openings H1203(*c*) and H1203(*d*) in each of which one side thereof communicates with an ink supply path, and in each of which the other side thereof passes through the first plate H1200 to thereby be opened to the outside. In the bubble buffer chamber H1203(*a*) and H1203(*b*) formed in the liquid discharge head unit H1002 so as to be opened to the outside, when the liquid discharge head unit H1002 is connected to the liquid container holder unit H1003, the openings H1203(*c*) and H1203(*d*) are stopped up by a joint seal H2300 provided in the liquid container holder unit H1003.

Thus, a closed space that communicates with the liquid supply path H1201 and that allows gas to exist is formed in the ink supply path, thereby enabling pressure oscillations occurring during ink discharge to be inhibited. In this embodiment, the arrangements are such that the thickness of the first plate H1200 is about 4 mm, and that each of the bubble buffer chambers H1203(*a*) and H1203(*b*) is a through hole with a diameter of 1.0 mm, communicating with the liquid supply path H1201. However, the dimensions of these first plate and the bubble buffer chamber are not limited to the above-described values. These dimensions may be set in keeping with the dimension of the ink jet recording head. Also, in this embodiment, an arrangement in which the bubble buffer chambers are formed in the supply path of black ink, has been described, but the bubble buffer chamber may be formed in the supply paths of color inks, as well.

With the described features, even in a side-shooter type ink jet recording head in which the electrothermal converters or piezo elements that impart a discharge energy to ink are opposed to the discharge ports, it is possible to form buffer chambers that have improved cleanability and that absorb ink oscillations during ink discharge, without the need for additional process and member.

Fourth Embodiment

Figure 15:
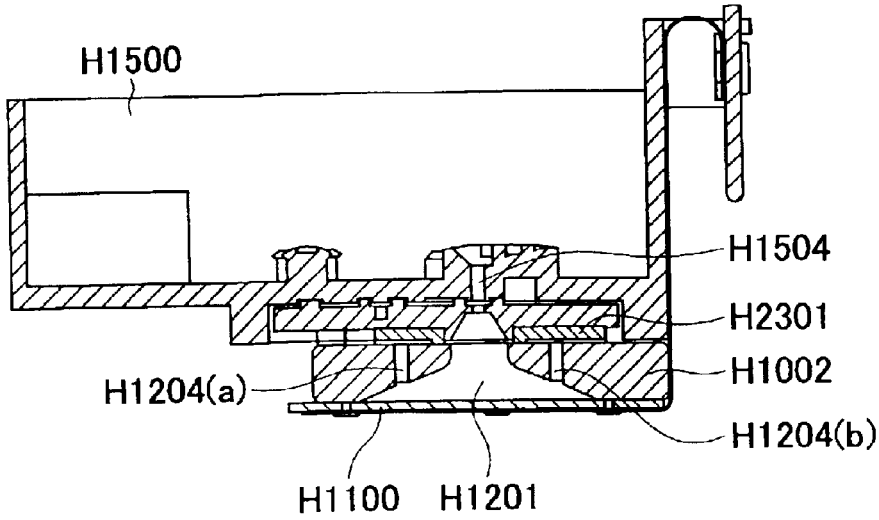
FIG. 15 is a schematic sectional view showing an ink jet recording head unit according to a fourth embodiment of the present invention.

FIG. 15 is a schematic sectional view showing the section of an ink jet recording head unit according to a fourth embodiment of the present invention. The ink jet recording head unit according to this embodiment is configured so that the formation positions of the bubble buffer chambers H1204(*a*) and H1204(*b*) are different from the case of the ink jet recording head in the third embodiment. In FIG. 15, the same reference numerals denote the same components as those of the third embodiment, and description thereof is omitted. In FIG. 15, the bubble buffer chambers 1204(*a*) and 1204(*b*) are provided to the first plate H1200, and formed adjacent to the center of the recording element substrate H1100 so as to make large the distance from the joint surface between the recording element substrate H1100 and the first plate 1200. The liquid supply path H1201 of the first plate H1200 is configured to continuously widen, with a tilt surface formed, from the connection portion between the liquid supply path H1201 and the liquid container holder unit 1003 toward the recording element substrate H1100 in the array direction of discharge ports, in order to improve recoverability during an ink suction recovery operation by a recording device (not shown). Here, if the bubble buffer chambers 1204(*a*) and 1204(*b*) directly communicate with the tilt surface of the liquid supply path 1201, when ink supplied from the liquid container holder unit 1003 side flows along the tilt surface of the liquid supply path H1201, the ink would contact the inside of the buffer chamber and would easily enter the buffer chamber. To avoid this, a surface parallel to the recording element substrate H1100 is formed on the tilt surface of the liquid supply path, and the bubble buffer chamber is caused to communicate with the parallel surface. This arrangement eliminates the risk of the entrance of the adhesive into the bubble buffer chamber during the joining of the recording element substrate H1100, and enables more stable bubble buffer chambers to be formed. When each of the bubble buffer chambers H1204(*a*) and H1204(*b*) is provided at the end of the ink supply path H1201, it is usually necessary to form each of the bubble buffer chambers at a location distant in a degree from the discharge ports at the end portion, in order that ink can also be sufficiently supplied to discharge portions at the end portion. However, in this case, since each of the bubble buffer chambers is formed at a location some distance from the discharge ports, there is no problem in the location of each of the bubble buffer chambers. This allows the ink jet recording head to be made more compact.

In the above-described embodiments, any path that serves as a buffer chamber is blocked by a seal rubber. However, in the present invention, any path that serves as a buffer chamber may instead be blocked by another member.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording head, comprising:

discharge ports each for discharging ink;

flow paths each communicating with a respective one of said discharging ports;

a common liquid chamber for supplying ink to said ink flow paths;

an element substrate having discharge energy generating elements; and a holding member holding said element substrate, and having said common liquid chamber and a plurality of paths communicating with said common liquid chamber, wherein a portion of said plurality of paths is used as an ink supply path, and wherein the other portion thereof is used as an air holding section formed by blocking an end of the path, opposite to the end thereof communicating with said common liquid chamber.

2. The ink jet recording head according to claim 1, wherein the end of each of said paths is blocked by an ink supply unit that supplies ink from an ink tank to said flow path.

3. The ink jet recording head according to claim 1, wherein said common liquid chamber is disposed adjacent to said element substrate in said holding member.

4. The ink jet recording head according to claim 1, wherein:

out of said plurality of paths, the path communicating with the center of said common liquid chamber constitutes an ink supply path, and the path communicating with the end portion of said common liquid chamber constitutes said air holding section.

5. The ink jet recording head according to claim 4, wherein a joining portion which joins said air holding section to said ink supply path is disposed on the opposite side of the discharge ports of said element substrate.

6. The ink jet recording head according to claim 4, wherein a joining portion which joins said air holding section to said ink supply path is disposed substantially parallel to the array direction of said discharge ports of said element substrate.

7. A method for manufacturing an ink jet recording head that includes discharge ports each for discharging ink; flow paths each communicating with a respective one of said discharging ports; a common liquid chamber for supplying ink to said ink flow paths; and an element substrate having discharge energy generating elements, said method comprising the steps of:

providing said ink jet recording head with a holding member that holds said element substrate and that has said common liquid chamber and a plurality of paths communicating with said common liquid chamber;

joining said element substrate to said holding member; and forming an air holding section by blocking an end of the path, opposite to the end thereof communicating with said common liquid chamber.

8. The method for manufacturing an ink jet recording head according to claim 7, wherein the end of the path is blocked by an ink supply unit that supplies ink from an ink tank to said flow path.

9. The method for manufacturing an ink jet recording head according to claim 8, wherein said ink supply unit has a seal member for sealing the surroundings of each of ink supply paths, and wherein the end of the path is blocked by said seal member.

* * * * *